United States Patent [19]

Yoshino et al.

[11] 4,051,666

[45] Oct. 4, 1977

[54] ELECTRONIC TIMEPIECE HAND-ADJUSTMENT MECHANISM

[75] Inventors: Masahito Yoshino; Kazuo Kawasumi, both of Suwa, Japan

[73] Assignee: Kabushiki Kaisha Suwa Seikosha, Tokyo, Japan

[21] Appl. No.: 633,735

[22] Filed: Nov. 20, 1975

[30] Foreign Application Priority Data

Nov. 21, 1974 Japan ..... 49-140908[U]

[51] Int. Cl.[2] ..... G04B 27/00; G04C 3/00

[52] U.S. Cl. ..... 58/85.5; 58/23 R; 58/64

[58] Field of Search ..... 58/23 D, 85.5, 23 R, 58/63, 64

[56] References Cited

U.S. PATENT DOCUMENTS 3,691,753 9/1972 Kurita ..... 58/23 R

*Primary Examiner*—E. S. Jackmon

*Attorney, Agent, or Firm*—Blum, Moscovitz, Friedman & Kaplan

[57] ABSTRACT

A hand-return mechanism for an electronic timepiece wherein at least one hand is advanced to a predetermined position is provided. The timepiece includes a display hand mechanically coupled to a positionable gear, the rotational position of the gear determining the rotary position of the hand. An electro-mechanical converter includes a rotor mechanically coupled to effect rotation of same. A manually operated hand-adjustment mechanism is adapted to be displaced from a rest position to an adjustment position, the adjustment mechanism being mechanically coupled to the gear, the adjustment mechanism effecting an advancement of the gear and rotor to predetermine respective positions corresponding to 10n second positions to which said hand is to be advanced, where $n = 1, 2, 3$.

10 Claims, 2 Drawing Figures

ELECTRONIC TIMEPIECE HAND-ADJUSTMENT MECHANISM

BACKGROUND OF THE INVENTION

This invention is directed to a hand-display electronic timepiece, and in particular to a hand-adjustment mechanism adapted to position the second hand of an electronic timepiece in a predetermined advanced position in response to the operation of the hand adjustment mechanism.

Heretofore, mechanisms for adjusting the second hand in electro-mechanical wristwatches have taken on various forms. For example, adjustments of ±0–1 seconds or $\pm n$ seconds, where $n=1, 2,3 \ldots$ by selectively displacing a winding stem have been provided. When the displacement of the winding stem effects a ±0–1 seconds second hand adjustment, seconds correction can only be effected when the second hand is in advance of actual time by either advancing the second hand at one second increments until the second hand is correctly positioned, and thereafter rotating the minute hand at least one entire revolution or by holding the second hand stationary until the position thereof is at or behind actual time. Moreover, if the second hand is slow by more than one second, repeated displacement of the winding stem is required in order to advance the second hand a sufficient number of one second increments to place same at a correct position. Since accurate information for setting a timepiece is usually given in ten second increments (radio, television and telephone) such repetitive advancing of the second hand does not always provide accurate adjusting of the second hand.

The second type of adjustment, namely, adjusting the second hand by $\pm n$ seconds is also less than completely satisfactory. For example, if the second hand is slower than or in advance of the $\pm n$ second increment by more than $n$ seconds, repetitive displacement of the winding stem will not effect proper adjustment. Specifically, if a two-way cam is utilized to position the second hand, $\pm n$ seconds, there is no assurance as to whether the second hand will be advanced or moved back by the $\pm n$ increment. Even if the proper direction is achieved on the first displacement of the winding stem, a displacement of the winding stem immediately thereafter will effect a rotation of the second hand back to the position to which same was first displaced by the preceding displacement of the winding stem. Accordingly, two-way positioning of the second hand at increments of $\pm n$ seconds provides a less than completely satisfactory second hand adjustment mechanism.

SUMMARY OF THE INVENTION

Generally speaking, in accordance with the invention, a hand-adjustment mechanism for a hand display electronic timepiece is provided. A display hand is mechanically coupled to a gear, the rotational position of the gear determining the rotary position of the hand. An electro-mechanical converter including a rotor is mechanically coupled to the gear to rotate the gear. A manually operable adjusting mechanism is mechanically coupled to the gear and effects an advancing of the gear to predetermine respective positions corresponding to $10n$ second positions of advance of the second hand, where $n=1,2,3$.

Accordingly, it is an object of this invention to provide an improved hand-adjustment mechanism for a high precision electronic wristwatch.

Another object of this invention is to provide an improved hand-adjustment mechanism adapted to advance the second hand to $10n$ second positions thereof, where $n=1,2,3$, without effecting the precision or accuracy of a timepiece.

Still another object of this invention is to provide an improved electronic timepiece wherein a clutch mechanism is not needed to adjust the second hand.

Still other objects and advantages of the invention will in part be obvious and will in part be apparent from the specification.

The invention accordingly comprises the features of construction, combinations of elements, and arrangement of parts which will be exemplified in the constructions hereinafter set forth, and the scope of the invention will be indicated in the claims.

BRIEF DESCRIPTION OF THE DRAWINGS

For a fuller understanding of the invention, reference is had to the following description taken in connection with the accompanying drawings, in which.

DETAILED DESCRIPTION OF THE PREFERRED EMBODIMENT

Figure 1:
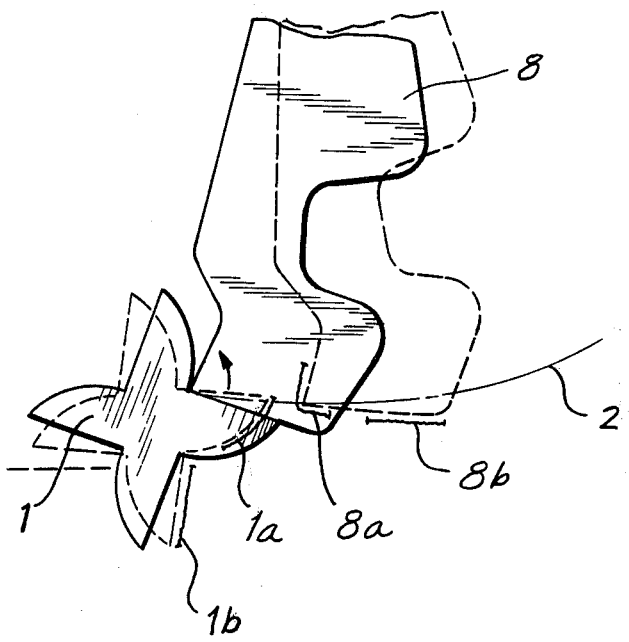
FIG. 1 is a partial elevational view of a portion of the hand-adjustment mechanism constructed in accordance with a preferred embodiment of the instant invention.

Reference is now made to FIG. 1, wherein a partial elevational view of the hand-adjustment cam 1 and regulating lever 8 of the instant invention are depicted. The hand-adjustment cam 1 is provided with a plurality of adjustment legs. Each cam includes a continuous curved trailing surface 1*a* and a flat leading surface 1*b*. A regulating lever 8 is adapted to be pivoted into engagement with the hand-adjustment cam so that the engaging tip 8*a* of the regulating lever is pivoted along a path defined by the locus 2 so that the engaging tip 8*a* engages the continuous curved surface 1*b* and rotates same in the direction of the arrow, until the flat surface of the hand-adjustment cam is brought into contact with flat surface 8*b* of the regulating lever 8. The position of the hand-adjustment cam 1 illustrated in solid lines in FIG. 1 is a hand-adjustment position and the position illustrated by the dotted lines is a position advanced with respect to the hand-adjustment position. The shape of each cam leg illustrated in FIG. 3 is exemplary of only one embodiment of the instant invention, the critical feature being that every cam leg trailing surface be so shaped that the engaging tip 8*a* of the regulating lever makes initial contact with the trailing surface of the cam unless during operation of the adjustment mechanism the cam is at a ten second position.

Figure 2:
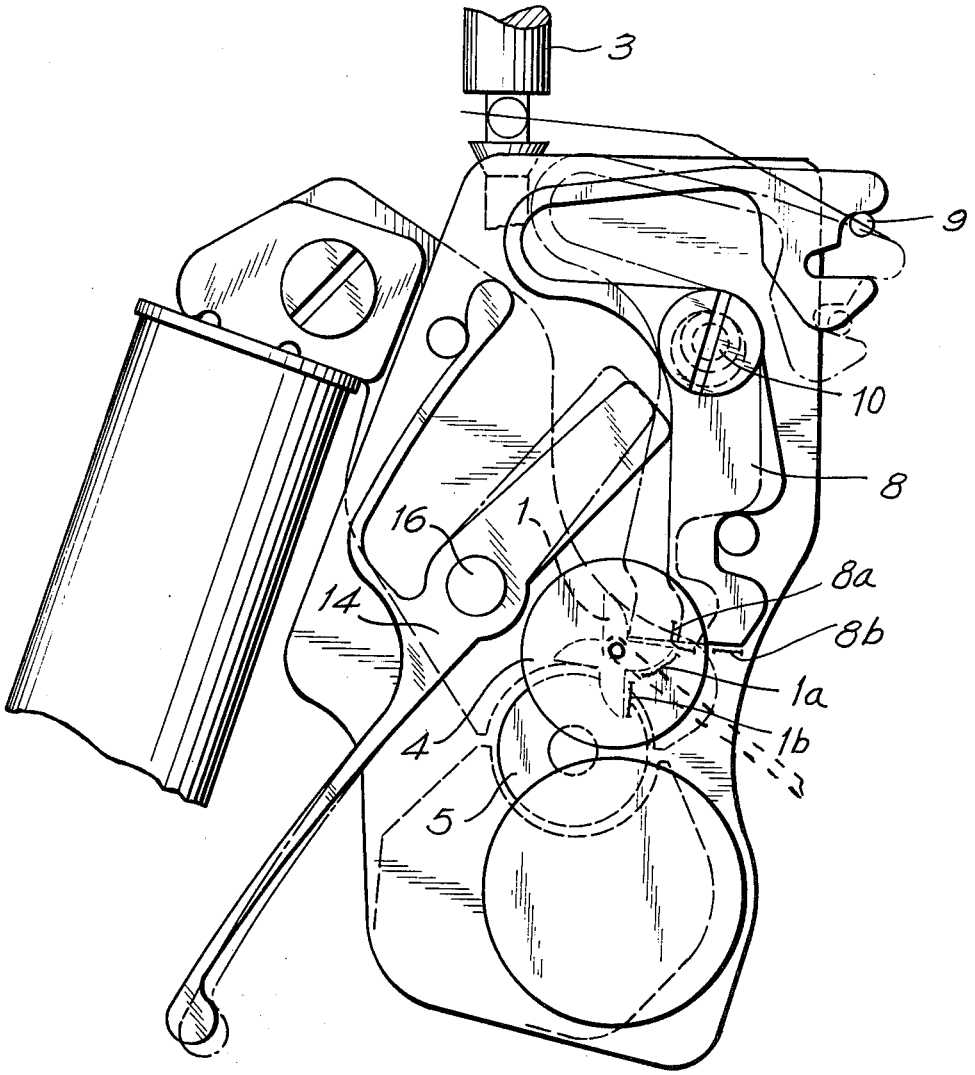
FIG. 2 is a detailed elevational view of an electronic wristwatch incorporating the hand-adjustment mechanism depicted in FIG. 1.

Referring now to FIG. 2, the disposition of the hand-adjustment cam 1 and regulating lever 8 in an electronic electro-mechanical wristwatch is illustrated. A winding stem 3 is mechanically coupled to the regulating lever 8 by a lever actuating pin 9. The regulating lever 8 is pivotally secured to the watch (not shown) by a pivot pin 10 in order to permit the regulating lever 8 to be pivoted thereabout. A reset lever 14 is rotatable about pivot pin 16 and is in engagement with regulating lever 8 to be pivoted by the pivoting of regulating lever 8. The reset lever 14 is adapted to be rotated into contact with a reset contact (not shown) for resetting the electronic timekeeping circuitry in response to rotation of regulating lever 8 in a manner well known in the art. Such a reset circuit and reset contact are illustrated in U.S. Pat. No. 3,744,234, issued on July 10, 1973, such patent being incorporated by reference herein. A hand adjustment gear 4 is mounted for the coaxial rotation coordinate with hand-adjustment cam 1, the hand-adjustment gear 4 being mechanically coupled to a rotor 5. Rotor 5 is part of the step motor electro-mechanical transducer conventionally utilized in an electronic timepiece and is illustrated and described in detail in U.S. Pat. No. 3,744,234. Accordingly, upon longitudinally displacing the winding stem 3, the actuating pin 9 effects a clockwise pivoting of the regulating lever 8 into contact with hand-adjustment cam 1. Specifically, the engaging tip 8*a* of the regulating lever 8 strikes the continuous curved trailing surface 1*a* of the hand-adjustment cam 1 and rotates same until the flat surface 8*b* of the regulating lever is brought into contact with the flat leading surface 16 of the hand-adjustment cam 1 to thereby fix the position of the hand-ajdustment cam. The adjustment of the time display by positioning of the second hand is as follows. If the second hand is coupled to the hand-adjustment gear 4, positioning of the hand-adjustment gear 4 will effect a likewise positioning of the second hand. Accordingly, the gear reduction ratio between the hand-adjustment gear 4 and the rotor 5 would be established so that the number of legs of the regulating cam would define 10 second interval positions. Thus, when the second hand is positioned between 1 second and 10 seconds, displacement of the winding stem 3 would fix the position of the hand-adjustment cam at the 10 second position. Similarly, when the second hand is between 11 and 20 seconds, the second hand would be positioned at a 20 second position. Accordingly, if the gear ratios are selected to position the second hand-adjustment gear 4 at 10 second increments, each displacement of the winding stem 3 will effect a rotation of regulating lever 8 into contact with hand-adjustment cam 1 and a fixing of the position thereof so as to advance the position of the second hand to the next 10 second position.

It is understood, that advancing of the second hand by 20 second or 30 second increments is easily achieved in one of several manners. Any number of camming surfaces can be provided and additionally, any number of gears or gear reduction ratios can be utilized to reduce or increase the increments over which the hand-adjustment gear 4 is advanced by the displacement of the winding stem 3.

It is therefore apparent that a considerable benefit inures to advancing the second hand to a 10 second position advance with respect to the rotation thereof instead of positioning same at ±5 second positions in response to a longitudinal displacement of the winding stem. If an electronic timepiece providing ±5 second adjustment is set at the time of a television, radio or telephone announcement, if the timepiece is 0 to 5 seconds fast the same result as the instant invention is obtained. However, if the second hand is more than 5 seconds slow, the second hand can only be set by the time announcement by manually displacing the winding stem and leaving same displaced for almost 55 seconds in order to provide the necessary correction. Thereafter, the winding stem must be rotated to set the minute hand ahead one further minute.

Similarly, since time announcement on the telephone, radio or television are given in 10 second increments, it is simple to effect the necessary adjustment by advancing the hand at 10 second increments. Similarly, a further advantage is that the driving torque of the hand-adjustment cam can be made high since same will only be rotated in one direction by the regulating lever.

Still a further advantage of the instant invention is provided by noting that when a timepiece loses more than 10 seconds, the hand-adjustment mechanism of the instant invention can regain the 20 seconds in about 2 second by manually displacing the stem, adjusting the hand by a unit of 10 seconds, returning the stem to the rest position, and after a further second pulling out the stem again to adjust the hand. By repeating the displacement of the stem, a quick feed operation whereby the hand is quickly advanced through the necessary increments is effected.

It will thus be seen that the objects set forth above, among those made apparent from the preceding description, are efficiently attained and, since certain changes may be made in the above constructions without departing from the spirit and scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

What is claimed is:

1. In a hand display electronic timepiece having a gear mechanically coupled to at least a second hand, the rotational position of the gear determining the time indication position of said hand and electro-mechanical converter means including a rotor mechanically coupled to said gear to rotate said gear, the improvement comprising manually operable adjusting means mechanically coupled to said gear, said adjusting means effecting an advancing of said gear and rotor to predetermined respective positions corresponding to $10n$ second positions of said second hand, where $n=1,2,3$, said adjusting means being adapted to effect an advancing of the second hand from substantially all positions of said second hand between said $10n$ second positions to the next $10n$ second position.

2. A hand display electronic timepiece as claimed in claim 1, wherein said manually operable adjusting means includes an adjustment cam operatively coupled to said gear, and a regulating lever adapted to advance said cam to one of said predetermined respective positions in response to displacement of said regulating lever from a rest position to an adjustment position.

3. A hand display electronic timepiece as claimed in claim 2, wherein said manually operable adjustment means includes a manually displaceable actuation member coupled to said regulating lever, said manually displaceable actuation member displacing said regulating lever to the adjustment position.

4. A cam display electronic timepiece as claimed in claim 2, wherein said regulating cam is provided with positioning legs, each of said legs having a first continuous curved surface and a flat positioning surface.

5. A hand display electronic timepiece as claimed in claim 1, wherein said electro-mechanical converter means is a step motor having a rotor, the rotation of said rotor effecting a corresponding rotation of said gear.

6. A hand display electronic timepiece as claimed in claim 2 wherein at least one of said predetermined positions of said gear is a 0 second display position of said second hand.

7. In a hand display electronic timepiece having a gear mechanically coupled to at least one of said hands, the rotational position of said gear determining the rotary position of said hand, and electro-mechanical converter means adapted to intermittently rotate said gear through specific periodic increments, camming means operatively coupled to said gear and having at least two predetermined orientations, said camming means being adapted to rotatably position said gear at predetermined positions corresponding to $10n$ second positions of said hand where $n = 1,2,3$ in advance of said second hand, and manually displaceable adjustment means for operatively engaging said camming means in such manner as to advance the rotation of said gear to one of said predetermined positions in response to displacement of said adjustment means from a rest to an adjustment position, said camming means and adjusting means being adapted so that said gear is advanced thereby from substantially all positions of said gear corresponding to positions of said hand between said $10n$ second positions of said hand to a position corresponding to the next $10n$ second position of said hand.

8. A hand display electronic timepiece as claimed in claim 7, wherein said adjustment means includes a regulating lever adapted to be pivoted between a rest and an adjustment position at which the regulating lever engages the camming means, rotation of the regulating lever into an adjustment position effecting an advancement of the camming means to said next predetermined position.

9. An electronic wristwatch as claimed in claim 8 wherein said regulating lever includes an engaging tip and said camming means includes a cam having at least two legs, each said legs having a leading surface and trailing surface defined by the direction in which said cam is rotationally advanced, a trailing surface of a leg being initially contacted by said engaging tip in response to displacement of said regulating lever to said adjustment position, unless said gear is at one of said predetermined positions.

10. An electronic wristwatch as claimed in claim 9 wherein said trailing surface of each cam leg is continuously inclined with respect to said regulating lever engaging tip to insure rotational advancement of said cam to one of said predetermined positions in response to said trailing surface being initially contacted by said engaging tip.

* * * * *